United States Patent [19]

Washio et al.

[11] 4,109,624

[45] Aug. 29, 1978

[54] VACUUM REGULATION VALVE IN AN EXHAUST GAS RECIRCULATION SYSTEM

[75] Inventors: Masayuki Washio, Hadano; Tetsuya Harada, Yokohama, both of Japan

[73] Assignees: Nissan Motor Company, Limited, Yokohama; Atsugi Motor Parts Company, Limited, Atsugi, both of Japan

[21] Appl. No.: 754,946

[22] Filed: Dec. 28, 1976

[30] Foreign Application Priority Data

Dec. 29, 1975 [JP] Japan ..... 50-178247[U]

[51] Int. Cl.[2] ..... F02M 25/06

[52] U.S. Cl. ..... 123/119 A; 251/61.1

[58] Field of Search ..... 123/119 A; 251/61.1, 251/61.2

[56] References Cited

U.S. PATENT DOCUMENTS

| | | | |
|---|---|---|---|
| 3,045,963 | 7/1962 | Herrmann | 251/327 |
| 3,441,245 | 4/1969 | Holland | 251/61.1 |
| 3,834,366 | 9/1974 | Kingsbury | 123/119 A |
| 3,896,777 | 7/1975 | Masaki et al. | 123/119 A |
| 3,982,515 | 9/1976 | Bradshaw | 123/119 A |
| 4,041,917 | 8/1977 | Suzuki | 123/119 A |

*Primary Examiner*—Charles J. Myhre
*Assistant Examiner*—Craig R. Feinberg
*Attorney, Agent, or Firm*—Bacon & Thomas

[57] ABSTRACT

A vacuum regulation valve operable to regulate the vacuum in the vacuum line of an exhaust gas recirculation system, includes a compact construction and a buffer means which is effective to eliminate the clattering sounds inherent in the conventional vacuum regulation valve.

8 Claims, 5 Drawing Figures

VACUUM REGULATION VALVE IN AN EXHAUST GAS RECIRCULATION SYSTEM

BACKGROUND OF THE INVENTION

The present invention relates to an exhaust gas recirculation system for an internal combustion engine, and more particularly to a vacuum regulation valve of the system.

An exhaust gas recirculation system is frequently employed as an effective measure of reducing the oxides of nitrogen emitted from an exhaust system in an internal combustion engine, particularly in an automobile.

Such a system is constructed to recirculate a portion of the exhaust gas from the exhaust system into the intake system of the engine so that the maximum combustion temperature can be reduced as a consequence of the dilution of the admitted air-fuel mixture with the recirculated exhaust gas.

To achieve a greater reduction in the oxides of nitrogen with minimal deterioration of automotive driveability, the amount of the recirculated exhaust gas should be proportional to engine air consumption throughout normal operating conditions of the engine.

To attain this object, the conventional exhaust gas recirculation system includes a vacuum regulation valve for regulating the vacuum in the vacuum line of the system before applied to the vacuum operated exhaust gas recirculation valve.

However, the conventional vacuum regulation valve particularly of the type with a compact construction has encountered the drawback that it produces undesirable clattering sounds under certain engine operating conditions, which sounds should be eliminated for quiet engine operation which assures safe driving of the automobile.

It is accordingly an object of the present invention to provide an improved vacuum regulation valve which is free from the drawback inherent in the conventional vacuum regulation valve.

It is another object of the present invention to provide a vacuum regulation valve of a compact construction.

BRIEF DESCRIPTION OF THE DRAWINGS

Other objects, features and advantages of the present invention will become apparent from the following description taken in connection with the accompanying drawings, in which.

DETAILED DESCRIPTION

Figure 1:
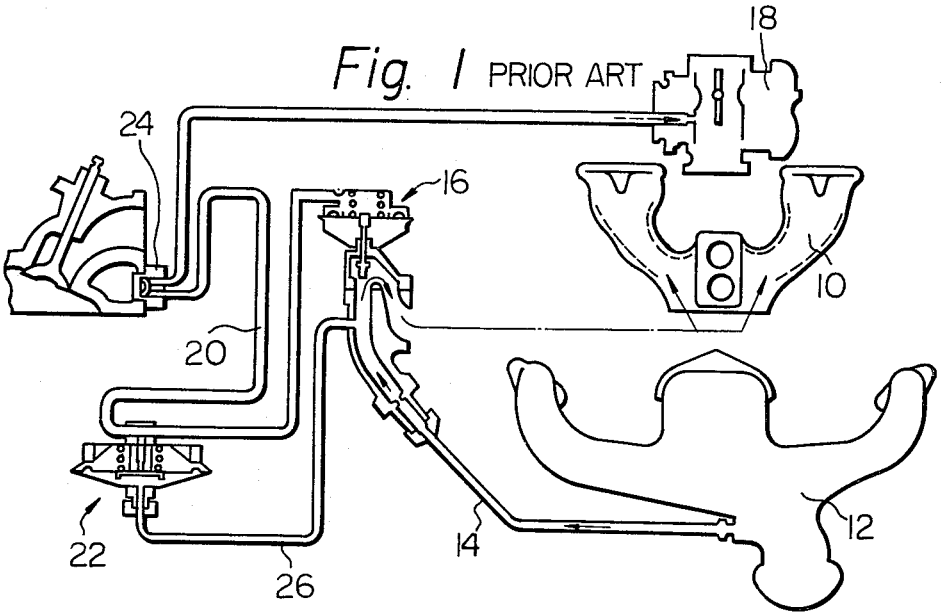
Fig. 1 PRIOR ART
FIG. 1 is a schematic view, partly in section, of an exhaust gas recirculation system for controlling the amount of the recirculated exhaust gas according to the prior art.

Referring to FIG. 1, designated by the reference numeral 10 is an intake manifold of an internal combustion engine (not shown) and by 12 an exhaust manifold. The intake and exhaust manifolds 10 and 12 are interconnected through a recirculation passageway or duct 14 for recirculating a portion of the exhaust gases back into the intake manifold 10. A vacuum operated exhaust gas recirculation valve 16 is provided in the recirculation passageway 14 for controlling the amount of the recirculated exhaust gas in accordance with the magnitude of the vacuum in the venturi section of a carburetor 18 of the engine. For conveying the vacuum of the venturi section of the carburetor 18 to the exhaust gas recirculation valve 16, a vacuum line 20 interconnects the carburetor and the exhaust gas recirculation valve. As shown in the drawing, a vacuum regulation valve 22 and thermostatic valve 24 are provided in the vacuum line 20. The vacuum regulation valve 22 is operable to regulate the vacuum in the vacuum line 20 in accordance with the magnitude of the pressure of the exhaust gas in the recirculation passage 14 for maintaining the proportion of the quantity of the recirculated exhaust gas to the quantity of air admitted into the intake manifold nearly constant. For this regulation, the vacuum regulation valve is in communication with the recirculation passage 14 through a duct 26. The thermostatic valve 24 is operable to shut off the vacuum line 20 for cutting the recirculation of exhaust gas into the intake system when the temperature of the engine coolant is lower than the predetermined level, such as during the engine idling condition, and to open the vacuum line for commencing the recirculation when the temperature of the engine coolant reaches the predetermined level.

As mentioned hereinbefore, the conventional vacuum regulation valve particularly of the type with a compact construction has encountered the drawback that it produces undesirable clattering sounds when the automobile is decelerating, viz, under the engine operating condition in which the engine is running without producing any driving torque.

Figure 2:
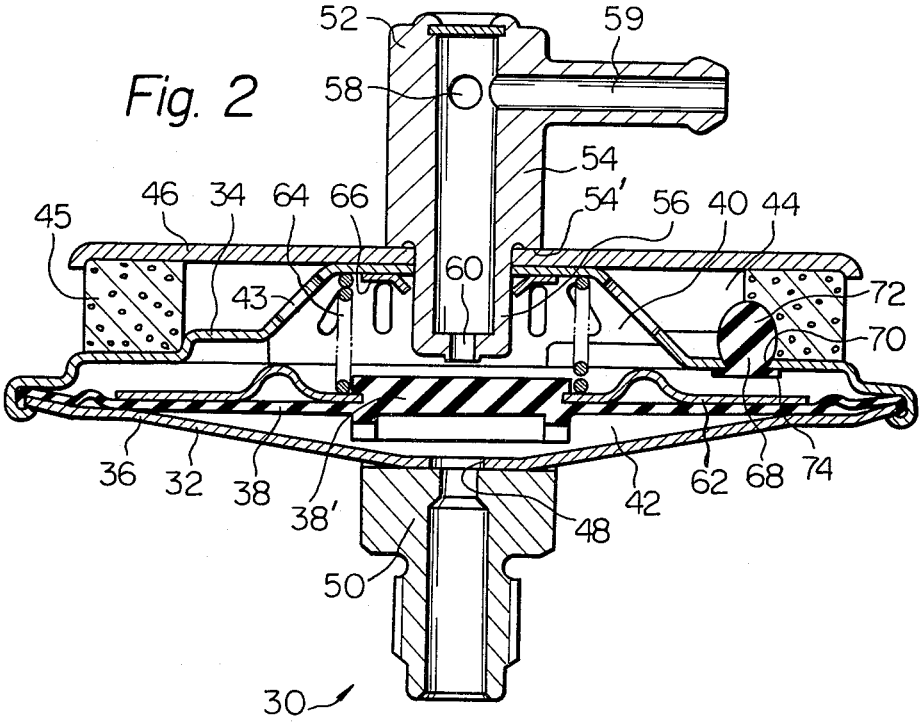
FIG. 2 is a sectional view of an improved vacuum regulation valve according to the present invention.

Such a drawback can be overcome by the vacuum regulation valve according to the present invention, one embodiment of which is shown in FIG. 2.

Referring to FIG. 2, the vacuum regulation valve 30 includes a casing 32 comprised of first and second shallow dish shaped members 34 and 36 which are hermetically joined together about their periphery and have a movable wall or a flexible diaphragm 38 disposed therebetween. In the embodiment illustrated, such hermetic joining is obtained by an inwardly turned flange of the first dash shaped member 34. The flexible diaphragm 38 extends transversely of the interior of the casing 32 to cooperate with the first and second dish shaped members 34 and 36 to define first and second chambers 40 and 42 respectively, and is formed with an integral valve portion 38'. The first chamber 40 is in communication with the atmosphere through openings 43 formed in the conical portion of the first dish shaped member 34 and further through an air filter 45. An end plate 46 of a generally flat configuration rests on the first dish shaped member 34 and defines therebetween an annular space 44. The air filter 45 of an annular configuration and preferably of foamed urethane is lodged in the space 44 and held thereat for filtration of air led into the first chamber 40. The second chamber 42 is in fluid communication with the recirculation passage (14 in FIG. 1) so that the pressure of the exhaust gas may be present therein. The second dish shaped member 36 is therefore formed with an opening 48 and is conveniently provided with a duct connector 50 secured thereto so as to fluidly communicate with the opening 48. Designated by the reference numeral 52 is an air vent conduit member including a connector portion 54 resting on the end plate 46 and a stem portion 56 projecting inwardly into the first chamber 40. The connector portion 54 is formed with a pair of branched passages 58 and 59 respectively connected to the vacuum line (20 in FIG. 1) in a manner, for example, that the passage 58 leads to the venturi portion of the carburetor and the passage 59 leads to the exhaust gas recirculation valve. The stem portion 56 is formed with an air vent port 60 in communication with the branched passages 58 and 59. The air vent port 60 is adapted to cooperate with the valve portion 38' of the diaphragm 38 which is movable between a first position closing the air vent port and a second position opening same. To facilitate this cooperation, the air vent valve port 60 is formed in the projected facing as shown or can be otherwise formed in the spherical facing. A backing plate 62 made of a metal sheet is secured on the diaphragm on the side facing the first dish shaped member 34 and movable with the diaphragm. The extent of the backing plate 62 is defined in accordance with the required effective pressure acting area of the diaphragm. As shown in the drawing, the backing plate 62 is formed with a central opening for engaging the groove in the valve portion 38' to be secured thereat. A coiled spring 64 is disposed between the backing plate 62 and the first dish shaped member 34 for urging the valve portion 38' of the diaphragm 38 toward the second position opening the air vent valve port 60. In order to assemble the casing 32, the end plate 46 and the air vent conduit member 52 together, the vacuum regulation valve 30 includes a fastening means such as a ring shaped fastener 66 as shown which cooperates with a shoulder 54' in the air vent conduit member to fixedly clamp therebetween the end plate and the first dish shaped member.

With these constructions and arrangements, the vacuum regulation valve 30 is operable to decrease the opening degree of the air vent port when the magnitude of the pressure in the second chamber 42 increases, and to increase the opening degree of the air vent port when the magnitude of the pressure in the second chamber 42 decreases.

It will be apparent that the vacuum regulation valve shown in FIG. 2 has a compact construction achieved particularly by arranging the air filter 45 on the first dish shaped member 34.

However, as mentioned before the vacuum regulation valve of such a compact construction produces undesirable clattering sounds particularly under the engine operating condition in which the engine does not produce any driving torque. It is found according to the present invention that such clattering sounds are caused by the backing plate 62 striking against the first dish shaped member 34.

From this reason, the vacuum regulation valve according to the present invention includes a buffer means for preventing said backing plate from striking said first dish shaped member. One embodiment of such buffer means is illustrated in FIG. 2 as a plurality of plug like rubber members 68 engaged in the corresponding openings 70 formed in the first dish shaped member 34. As shown in the drawing, the plug like rubber member 68 includes a bulb shaped portion 72 projecting into the space 44 and a flange portion 44 located between the backing plate and the first dish shaped member. The bulb shaped portion 72 is so shaped as to be forced into the opening 70 by the elastic deformation thereof and to be resiliently engaged with same. The bulb shaped portion 72 projected into the space 44 preferably serves as a stopper which advantageously prevents the air filter 45 from being deformed inwardly into the space 44 by the atmospheric pressure.

Although the buffer means incorporated in the vacuum regulation valve according to the present invention has only been described and shown as plug like rubber members, such is merely by way of example and therefore modifications and changes can be made within the scope of the present invention.

Figure 3:
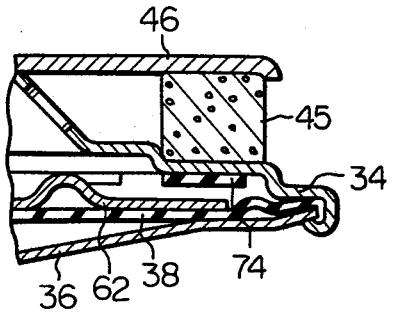
FIGS. 3 to 5 are fragmentary sectional views showing the various modified embodiments of a buffer means according to the present invention.
Figure 4:
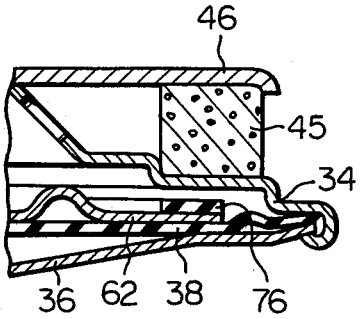
Figure 5:
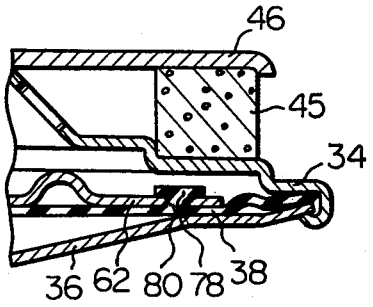

As illustrated in FIGS. 3 to 5, for example, the buffer means can be a plurality of rubber sheet members 74 (FIG. 3) arranged in circular array on either the first dish shaped member 34 or the backing plate 62 though shown as arranged on the first dish shaped member 34 in FIG. 3, or an annular shaped rubber sheet member 76 (FIG. 4) on either the first dish shaped member 34 or the backing plate 62 though shown as arranged on the backing plate 62 in FIG. 4, or a plurality of projections 78 integrally formed with the diaphragm 38 which project toward the first dish shaped member 34 through corresponding opening 80 in the backing plate 62. As seen from FIG. 5, each of the projections 78 preferably have an end portion with a larger diameter than the corresponding circular opening 80 so as to fixedly secure the backing plate 62 to the diaphragm 38.

From the foregoing description, it will be apparent that the vacuum regulation valve according to the present invention includes a buffer means effective to eliminate the undesirable clattering sounds inherent in the conventional vacuum regulation valve.

What is claimed is:

1. In an exhaust gas recirculation system having a recirculation passageway connecting an intake manifold of an internal combustion engine with an exhaust manifold for recirculating a portion of the exhaust gas therethrough, an exhaust gas recirculation valve with a vacuum chamber in the recirculation passageway, a vacuum line connecting a venturi section of a carburetor of the engine with the vacuum chamber, and a vacuum regulation valve operable to regulate the vacuum in said vacuum line for maintaining the proportion of the quantity of the recirculated exhaust gas to the quantity of air admitted into the intake manifold nearly constant, the vacuum regulation valve comprising:

a casing composed of first and second dish shaped members;

an end plate of a generally flat configuration resting on said first dished shape member for defining therebetween a generally annular space;

an air filter lodged in said space;

a flexible diaphragm with an integral valve portion disposed within said casing to cooperate with said first and second dished shaped members to define first and second chambers respectively, said first chamber in communication with the atmosphere through said air filter and said second chamber fluidly in communication with said recirculation passageway;

an air vent conduit member including a connector portion resting on said end plate and a stem portion projecting inwardly of said first chamber, said connector portion formed with branched passages respectively connected to said vacuum line and said stem portion formed with an air vent port in communication with said branched passages, said air vent port adapted to cooperate with the valve portion of said diaphragm which is movable between a first position closing said air vent port and a second position opening same;

a backing plate made of a metal sheet secured on said diaphragm on the side facing said first dish shaped member and movable with said diaphragm;

a coiled spring disposed between said backing plate and said first dish shaped member for urging the valve portion of said diaphragm toward said second portion;

a fastening means for fixedly assembling said air vent conduit member, said end plate and said casing together; and a buffer means for preventing said backing plate from striking said first dish shaped member.

2. A vacuum regulation valve as set forth in claim 1, in which said buffer means includes a plurality of rubber sheet members arranged in circular array on one of the first dish shaped member and the backing plate.

3. A vacuum regulation valve as set forth in claim 1, in which said buffer means includes an annular shaped rubber sheet member arranged on one of the first dish shaped member and the backing plate.

4. A vacuum regulation valve as set forth in claim 1, in which said buffer means includes a plurality of projections integrally formed with the diaphragm which project toward the first dish shaped member through corresponding openings in the backing plate.

5. A vacuum regulation valve as set forth in claim 4, in which each of said projections includes a cylindrical end portion with a larger diameter than the corresponding circular opening in the backing plate.

6. A vacuum regulation valve as set forth in claim 1, in which said buffer means includes a plurality of plug like rubber members resiliently fixed to said first dish shaped member.

7. A vacuum regulation valve as set forth in claim 6, in which each of said plug like rubber members includes a bulb shaped portion projecting into said space and a flange portion located between said backing plate and said first dish shaped member.

8. A vacuum regulation valve as set forth in claim 7, in which said bulb shaped portion includes an outer surface cooperating with the air filter.

* * * * *